US008911039B2

(12) United States Patent
Radusin

(10) Patent No.: US 8,911,039 B2
(45) **Date of Patent: *Dec. 16, 2014**

(54) PULL-OUT GUIDE HAVING A SELF-RETRACTING DEVICE

(71) Applicant: Darko Radusin, Bielefeld (DE)

(72) Inventor: Darko Radusin, Bielefeld (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/036,512

(22) Filed: Sep. 25, 2013

(65) Prior Publication Data

US 2014/0021840 A1 Jan. 23, 2014

Related U.S. Application Data

(60) Continuation-in-part of application No. 13/680,717, filed on Nov. 19, 2012, now abandoned, which is a division of application No. 12/681,514, filed as application No. PCT/EP2008/062941 on Sep. 26, 2008, now abandoned.

(30) Foreign Application Priority Data

Oct. 2, 2007 (DE) ..... 20 2007 013 799 U
Mar. 7, 2008 (DE) ..... 20 2008 003 328 U

(51) Int. Cl.

| | |
|---|---|
| ***A47B 95/00*** | (2006.01) |
| ***A47B 88/16*** | (2006.01) |
| ***A47B 88/04*** | (2006.01) |

(52) U.S. Cl.

CPC ..... *A47B 88/16* (2013.01); *A47B 88/047* (2013.01); *A47B 2210/0059* (2013.01)

USPC ..... 312/333

(58) Field of Classification Search

USPC ..... 312/333, 334.1, 334.4, 334.7, 334.8, 312/334.44, 334.46

See application file for complete search history.

(56) References Cited

U.S. PATENT DOCUMENTS

| | | | | |
|---|---|---|---|---|
| 5,207,781 | A | | 5/1993 | Rock |
| 5,240,318 | A | | 8/1993 | Schroder et al. |
| 5,302,016 | A | | 4/1994 | Lautenschlager et al. |
| 5,474,375 | A | * | 12/1995 | Hollenstein et al. ..... 312/319.1 |
| 5,580,138 | A | | 12/1996 | Grabher |
| 6,340,078 | B1 | | 1/2002 | Scheible |
| 6,736,471 | B2 | | 5/2004 | Lin |
| 6,953,233 | B2 | | 10/2005 | Lam et al. |
| 7,384,108 | B2 | | 6/2008 | Lam et al. |

(Continued)

FOREIGN PATENT DOCUMENTS

DE 203 01 340 5/2003

OTHER PUBLICATIONS

International Search Report for international Application No. PCT/EP2008/062941. mailed Sep. 26, 2008.

*Primary Examiner* — Matthew Ing
(74) *Attorney, Agent, or Firm* — Barnes & Thornburg LLP

(57) ABSTRACT

A pull-out guide for a drawer or for a pull-out of a piece of furniture. The pull-out guide includes a guide rail, a self-retracting device mounted on the guide rail, a running rail mountable on the drawer or furniture pull-out, an actuator attached to the running rail to control the self-retracting device, and a closing stopper.

9 Claims, 18 Drawing Sheets

(56) References Cited

U.S. PATENT DOCUMENTS

| | | | | |
|---|---|---|---|---|
| 7,654,625 | B2 | 2/2010 | Amann et al. | |
| 2002/0011766 | A1 | 1/2002 | Kim et al. | |
| 2004/0245898 | A1 * | 12/2004 | Amann et al. | 312/334.46 |
| 2006/0175946 | A1 | 8/2006 | Le | |
| 2007/0046158 | A1 | 3/2007 | Hoffman | |
| 2007/0228911 | A1 | 10/2007 | Kim et al. | |
| 2008/0067905 | A1 | 3/2008 | Guiles | |
| 2008/0245630 | A1 | 10/2008 | Le | |

* cited by examiner

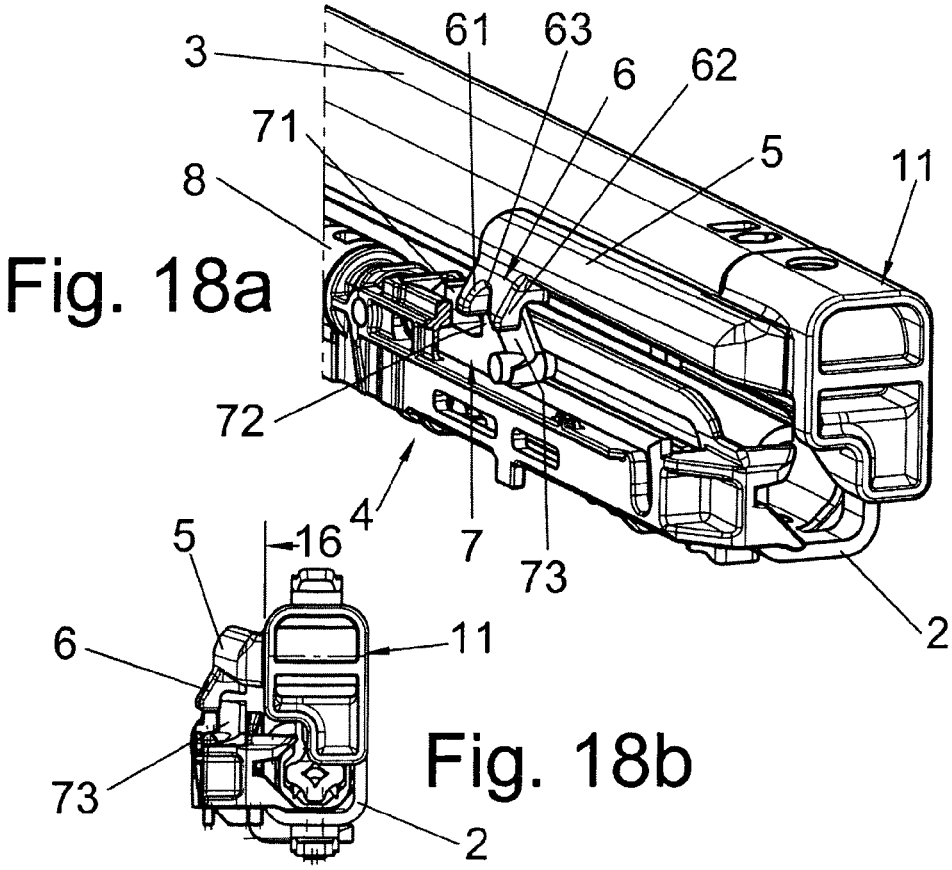
Fig. 18a
Fig. 18b
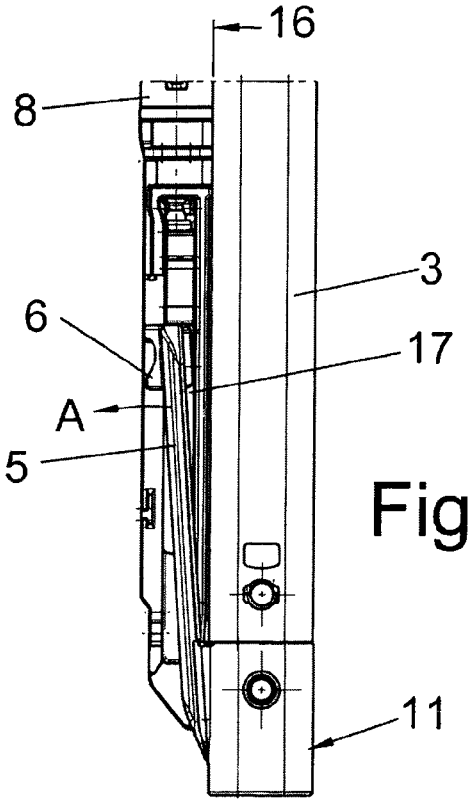
Fig. 18c

PULL-OUT GUIDE HAVING A SELF-RETRACTING DEVICE

This is a Continuation-in-Part Application of U.S. Non-Provisional patent application Ser. No. 13/680,717, filed Nov. 19, 2012 and now abandoned, which is a divisional of U.S. Non-Provisional patent application Ser. No. 12/681,514, filed on Apr. 2, 2010 and now abandoned, the disclosures of which applications are incorporated by reference herein. Application Ser. No. 12/681,514 is a §371 National Stage of PCT/EP2008/062941, filed on Sep. 26, 2008, which claims benefit of German Application Number 20 2007 013 799.0 filed on Oct. 2, 2007 and of German Application Number 20 2008 003 328.4 filed on Mar. 7, 2008.

The present disclosure relates to a pull-out guide having a self-retracting device for drawers, furniture pull-outs or the like. The pull-out guide includes a guide rail that can be attached to the body of furniture, the self-retracting device being mounted on the guide rail. Further included is a running rail that can be mounted to a drawer, a furniture pull-out or the like, and an actuator for controlling the self-retracting device being attached to the running rail.

Pull-out guides of the above-mentioned type are known in many different variants.

One of the essential criterion of such pull-out guides is a self-retracting device and the actuator, by which the self-retracting device is controlled.

The self-retracting device is a force storage device which, when a drawer, a furniture pull-out or the like, is pulled out of the closed position, and is tensioned by coupling with the actuator. This takes place by way of a relatively short pull-out path, and after the complete tensioning of the force storage device, the actuator will move the self-retracting device to a position in which the tensioned position of the energy storing device is fixed. Any further displacement will than result in a separation of the actuator from the self-retracting device. A drawer, a furniture pull-out or the like can then be moved into a completely pulled-out or opened position without any further influence on the self-retracting device. When a drawer, a furniture pull-out or the like is now again moved into the closing direction, the actuator will, in a defined displacement position of the running rail, arrive in the contact area with the self-retracting device with the result that the blocking of the force storage device is canceled and the actuator is again coupled with the self-retracting device. By way of this coupling, the force then inherent in the tensioned force storage device will be utilized for automatically moving a drawer, a furniture pull-out or the like into a final closed position.

In the case of known pull-out guides of the above-mentioned type, the actuator is fixedly connected with the running rail, preferably by welding.

This has various disadvantages.

On the one hand, the welding operation may have a negative effect on the appearance and the corrosion characteristic of the running rail. On the other hand, the manufacturer already has to decide whether or not a running rail is to be equipped with an actuator. A subsequent attachment of an activator, for example, by the final customer when a self-retracting device is installed subsequently, would not be possible by conventional devices or would be possible only if considerable inconveniences were accepted.

The present disclosure relates to an improvement of a pullout guide of the above-mentioned type such that the attaching of the actuator on the running rail is considerably simplified and can easily be carried out, for example, subsequently by a middleman or the final customer.

The present disclosure includes a feature that the actuator is fixed on the running rail in a locking manner.

Thus, the running rail, therefore, only has to be prepared for enabling an actuator to be lockable on this running rail. It will not be absolutely necessary for the actuator itself to already be mounted on the pull-out guide during the manufacturing of the entire pull-out guide. This may be because it is not yet certain at that point in time whether the corresponding running rail is to be used for a pull-out guide with or without a self-retracting device. And, as required, therefore, it may also be attached at a later point in time and in a different location.

As a result, the entire production of pull-out guides is significantly facilitated because, from the start, no division will be required into those running rails which are to be equipped with an actuator and those which require no actuator.

The actuator and a closing stopper may inserted into the forward area of the running rail form a subassembly which in its entirety is fixed on the running rail by an interlocking and/or frictional fixing of the closing stopper with respect to the running rail.

This solution also has the advantage that it may not be absolutely necessary to already mount the actuator on the pull-out guide during the manufacturing of the entire pull-out guide because, in this case, the subassembly including the actuator and the closing stopper can be fixed on a running rail in a simple manner at any later point in time.

According to a further embodiment according to the present disclosure corresponding to the first suggested solution, it is provided that the actuator is attached in the forward end area of the running rail.

This is advantageous in that, in the case of a subsequent mounting of the actuator, there will be no space-related problems because the running rail can always be moved so far into the pull-out position that the forward end area of the running rail will be completely freely accessible and the mounting of a lockable actuator will therefore be possible without any problem.

Another advantage of an embodiment in accordance with the present disclosure and corresponding to the first suggested solution, provides that the actuator is lockingly fixed in a closing stopper inserted into the forward end area of the running rail.

An advantage of this measure is that the locking devices can be designed to be relatively stable and nevertheless sufficiently resilient because they do not have to be fixed with respect to the thin-walled area of the running rail. However, sufficient space exists in the area of the closing stopper for carrying out a generous dimensioning.

The actuator is advantageously equipped with two detent hooks of which at least one extends through the closing stopper in the area of an opening, and which, by detent noses, provided at their free ends, reach in a locking manner behind a web at the rearward end of the closing stopper or behind a web between the two openings.

In this case, the closing stopper and the actuator itself are advantageously constructed as plastic parts. It thereby becomes possible to dimension the connection between the closing stopper and the actuator in a relatively precise fashion and with comparatively small tolerances. Another advantage of the use of plastic material, for example, for the actuator, is the fact that the generating of noise when operating the self-retracting devices is kept comparatively low.

Other aspects of the present disclosure will become apparent from the following descriptions when considered in conjunction with the accompanying drawings.

BRIEF DESCRIPTION OF THE DRAWINGS

FIG. 18*a* is a perspective view, FIG. 18*b* is a front view and FIG. 18*c* is a top view of the pull-out guide of FIG. 11 where a tooth of the control nose moves along a curved plane of a wall of a driving device of the self-retracting device.

DETAILED DESCRIPTION

Figure 1:
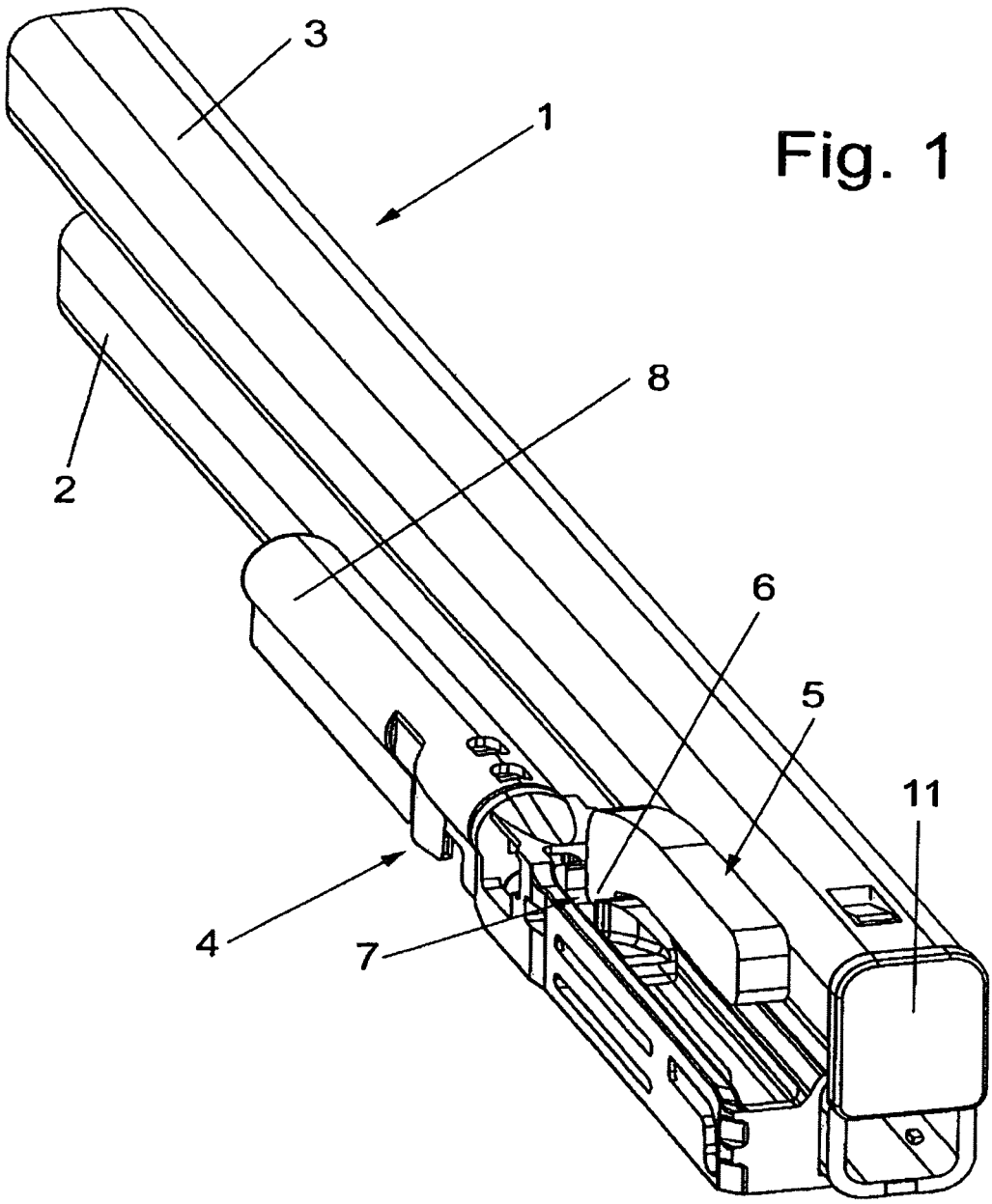
FIG. 1 is a perspective view of a pull-out guide, according to the present disclosure, showing a self-retracting device in the pushed-together closed condition of the pull-out guide of FIG. 1.
Figure 2:
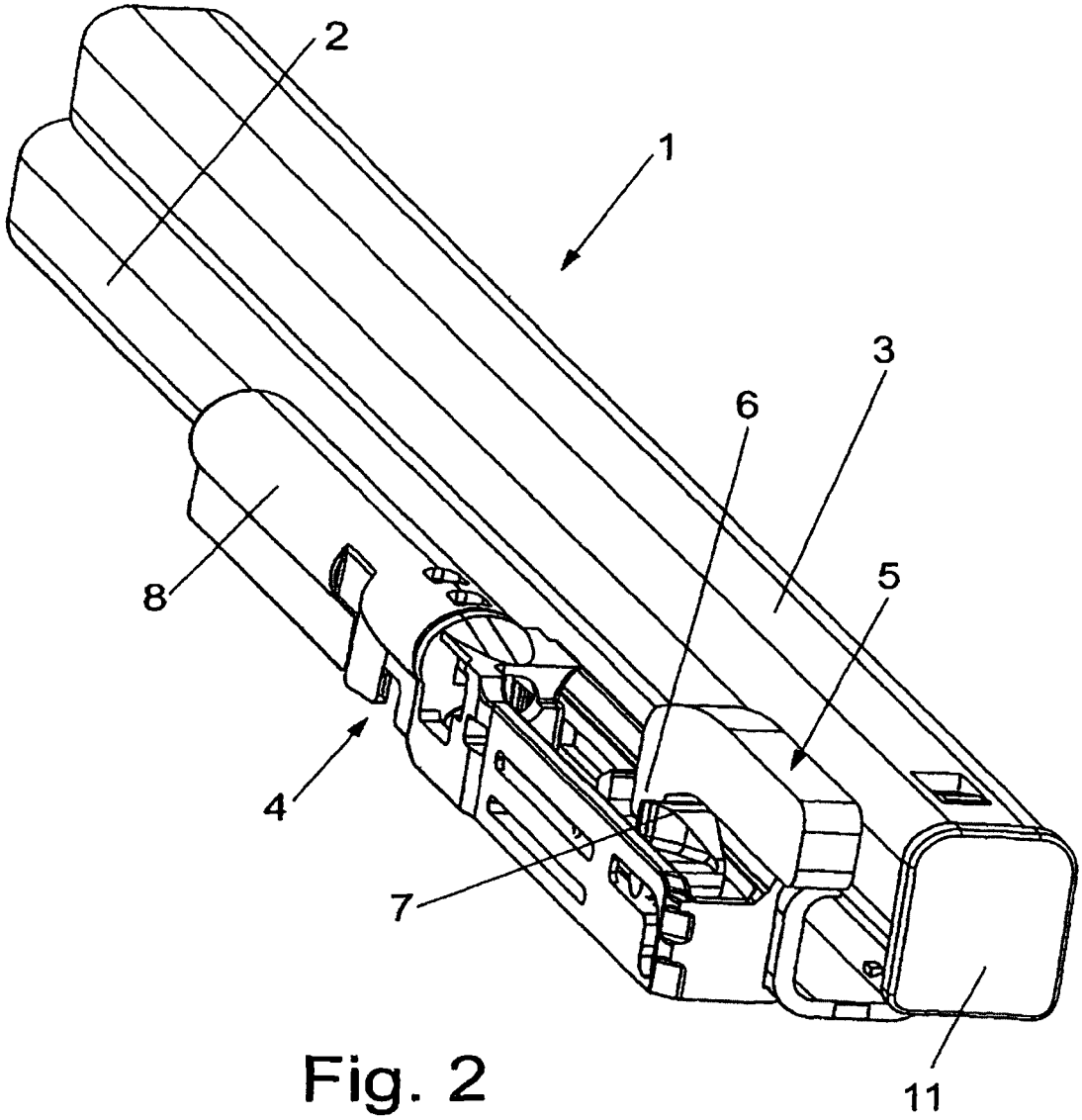
FIG. 2 is a perspective view of the pull-out guide of FIG. 1 showing a partially pulled-out running rail while the self-retracting device is completely tensioned.
Figure 3:
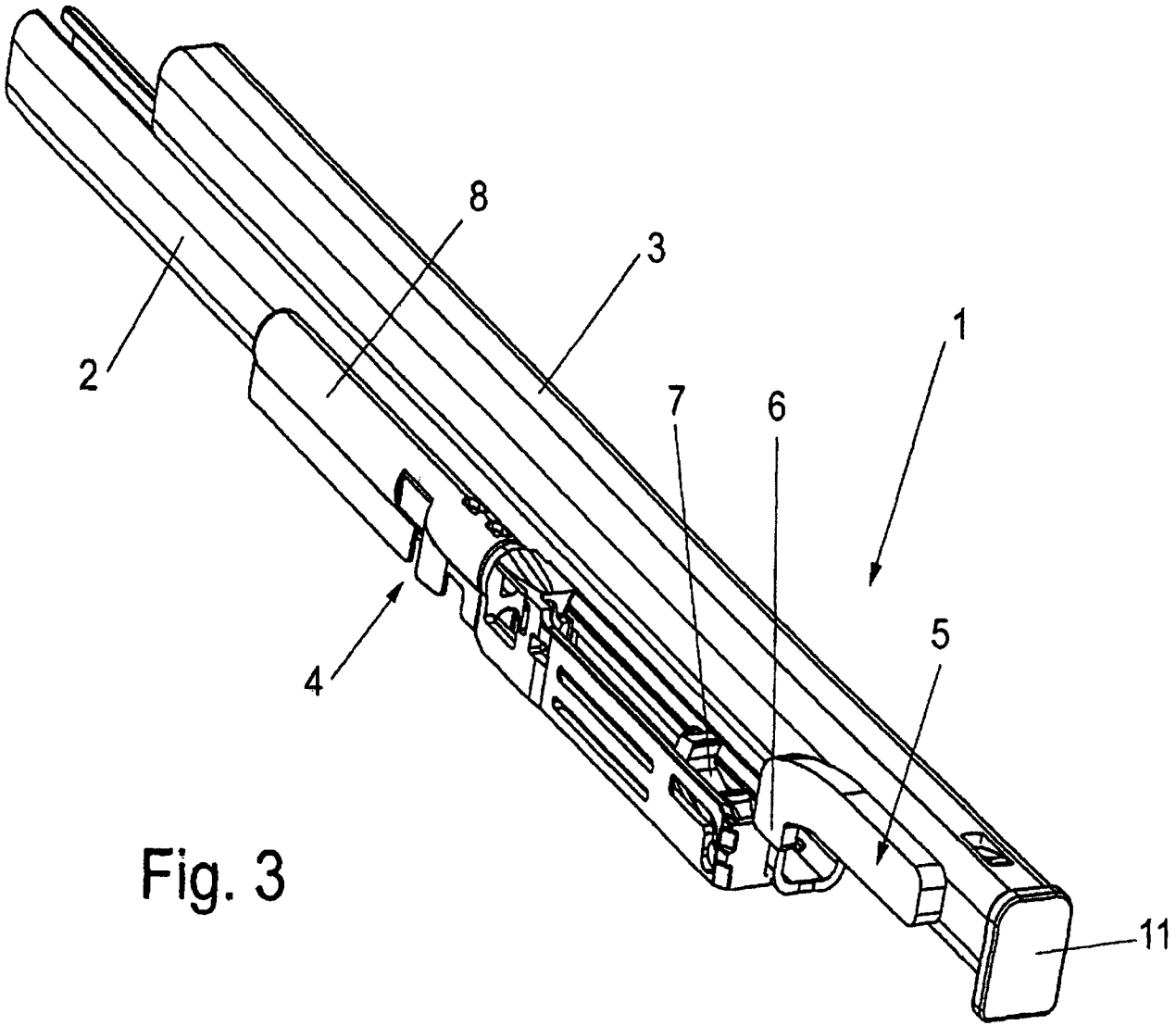
FIG. 3 is a perspective view of the pull-out guide of FIG. 1 after the separation of the actuator from the self-retracting device.

FIGS. 1 to 3 illustrate a pull-out guide 1. Pull-out guide 1 includes a guide rail 2 attachable to a furniture body and a running rail 3 that can be mounted on a drawer, a furniture pull-out or the like. Further included is a self-retracting device 4, the self-retracting device 4 being controlled by way of an actuator 5 connected to the running rail 3.

The actuator 5 is equipped with a control nose 6 which, when the pull-out guide 1 is completely pushed together, corresponding to the closed position of a drawer, a furniture pull-out or the like, engages in a driving device 7 of the self-retracting device 4. This is shown in FIGS. 1 and 2.

FIG. 2 shows a position of the running rail 3 in which this running rail 3 is displaced by a certain path with respect to the guide rail 2 in the pull-out direction. During this displacement, a force storage device 8 of the self-retracting device 4 is tensioned by the actuator 5 and concretely by its control nose 6 as well as the driving device 7. When a defined pull-out path is exceeded by the running rail 3, the driving device 7 will be tilted away out the engagement range with the actuator 5 by being guided correspondingly and will be locked in this position. The running rail 3 can now be pulled out into its complete pull-out position, and the self-retracting device 4 remains in a position in which the force storage device 8 is completely tensioned.

When the running rail 3 is now pushed back again into the closing direction, the control nose 6 will again arrive in the range of the driving device 7 in a certain displacement position, will unlock the driving device 7 and will thereby release the force storage device 8. As a result of the corresponding force, the running rail 3 will then automatically be pulled back into the closing direction by way of the interaction between the driving device 7 and the actuator 5.

This method of operation and functioning of a self-retracting device 4 is generally known.

Figure 4:
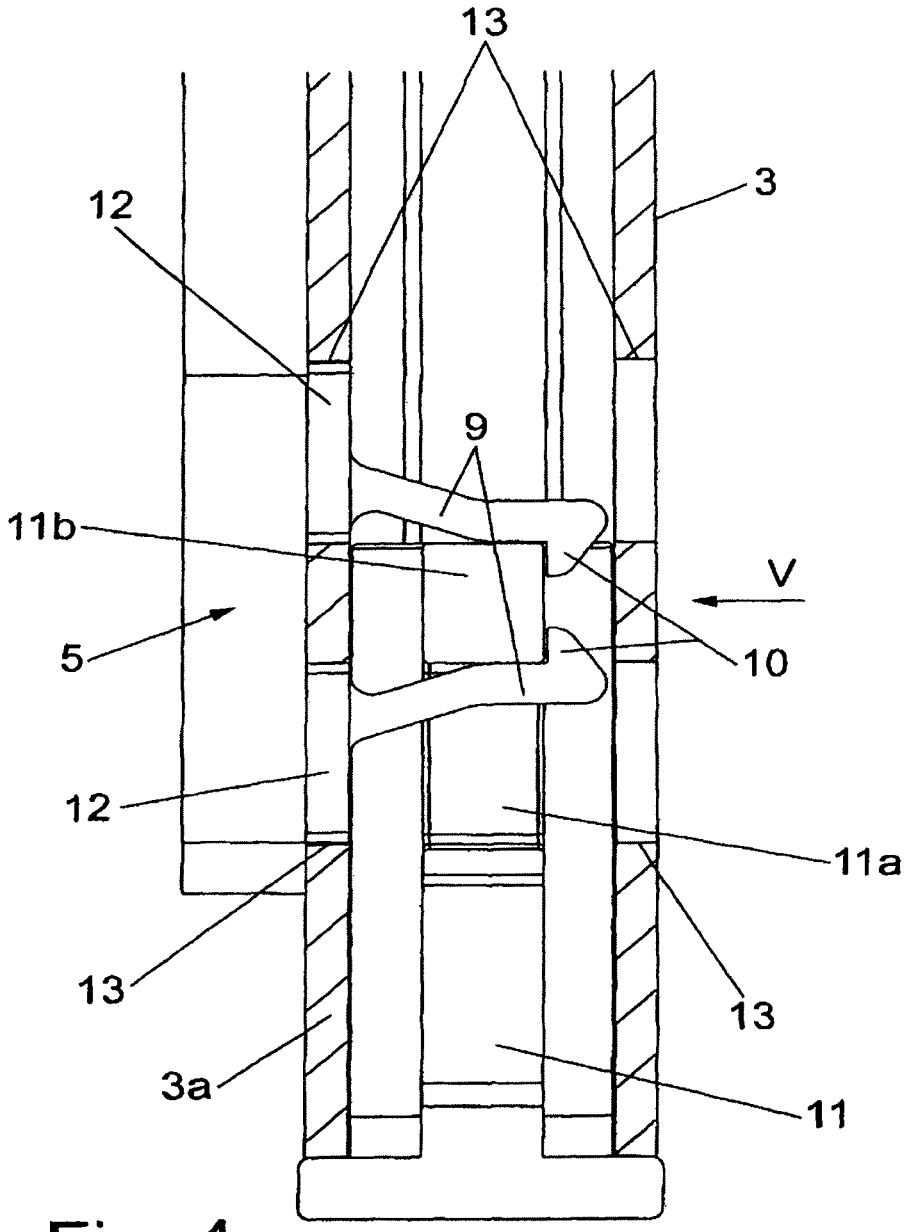
FIG. 4 is a sectional view of the forward end area of a running rail of the pull-out guide of FIG. 1, in which the running rail is equipped with an actuator.

As shown in FIG. 4, the actuator 5 is fixed with respect to the running rail 3 in a locking manner, for example, by a locking device.

For this purpose, the actuator 5 is equipped with two detent hooks 9 which are provided with detent noses 10 at their free ends. The detent hooks 9 extend through a side wall 3*a* of the running rail 3, and one of the detent hooks 9 extends through the closing stopper 11 in the area of an opening 11*a*. The detent noses 10 reach behind a web 11*b* at the rearward end of the closing stopper 11.

The closing stopper 11 may also be provided with two openings 11*a*, the detent hooks 9 extending through the latter. The detent noses 10 will then reach behind a web 11*b* which is situated between the one or two openings 11*a*.

Figure 6:
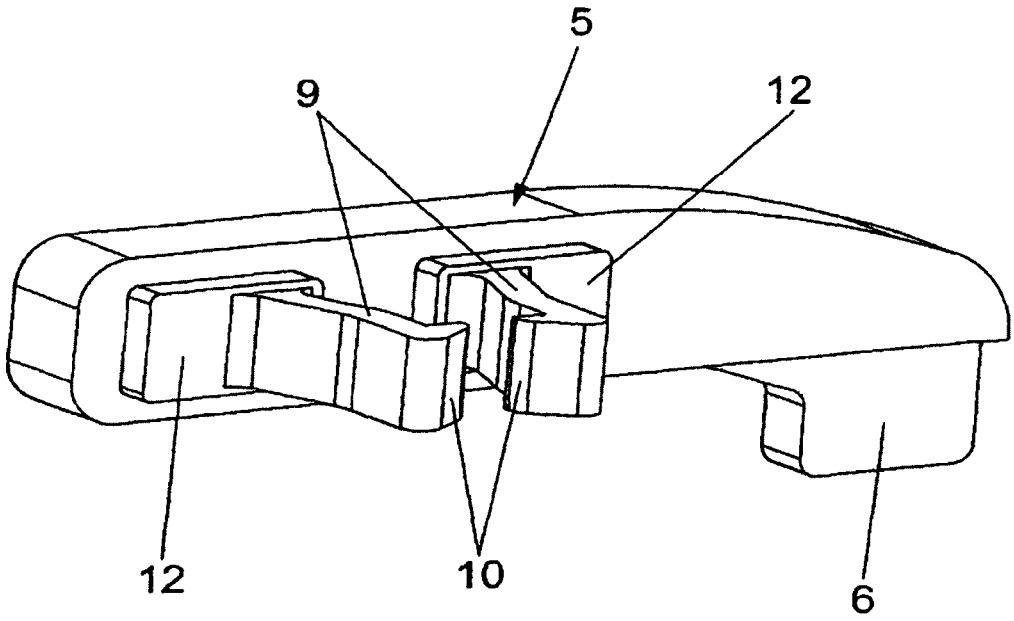
FIG. 6 is a perspective view of the actuator of FIG. 4 in the direction of the connection area of the actuator with respect to the running rail.

As shown in FIG. 4 in connection with FIG. 6, the detent hooks 9 are molded onto rectangular bases 12 of the actuator 5. These bases 12 project into correspondingly dimensioned openings 13 of the side wall 3*a* of the running rail 3 and stabilize the position of the actuator 5 when the latter reaches around the web 11*b* of the closing stopper 11 by way of its detent hooks 9 and detent noses 10.

The actuator 5, as a whole, is constructed in one piece as a plastic part, for example, as a plastic injection-molded part. The same applies to the closing stopper 11. Thus, concerning the fixing of the actuator 5 with respect to the running rail 3, as a result of the possibility of manufacturing the actuator 5 and the closing stopper 11 with relatively small tolerances, a very good positioning of the actuator 5 with respect to the running rail 3 can be achieved, such as, for example, in a locking manner.

Figure 5:
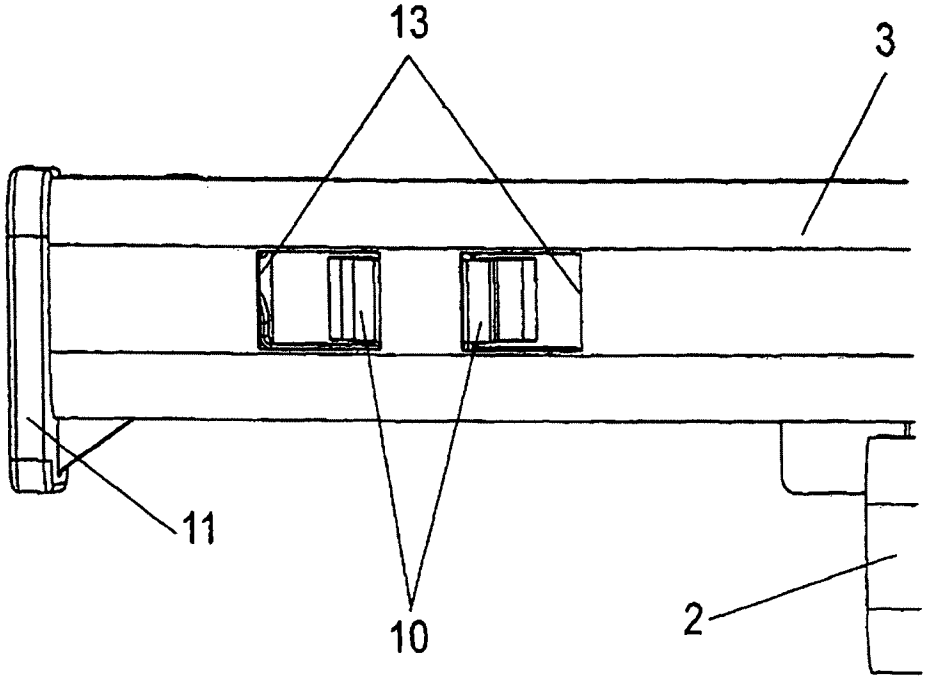
FIG. 5 is a view in the direction of the arrow V of FIG. 4, rotated by 90° with respect to the position of the drawing of FIG. 4.

As shown in FIG. 4 and FIG. 5, the running rail 3 is provided with openings 13 on both opposite sides, so that it becomes possible to mount the actuator 5 on the left or right side of the running rail 3, depending on where the self-retracting device 4 is mounted on the guide rail 2.

Since the closing stopper 11 is used to a decisive degree for the fixing of the actuator 5 with respect to the running rail 3, special measures are not required, with the possible exception of the providing of the openings 13, which would impair the production or manufacturing of the running rail 3. For example, no components have to be fastened on the running rail 3.

As a result, the manufacturing of the running rail 3, and thereby of the entire pull-out guide 1 as a whole, is significantly simplified and becomes less expensive. It becomes possible to fix the actuator 5 on the running rail 3 even after the manufacturing of a complete pull-out guide 1.

Since pull-out guides 1, with as well as without self-retracting devices, are manufactured and needed in large quantities, the above-described construction has an advantage that an early division of the production lines into pull-out guides 1 with and pull-out guides 1 without self-retracting devices 4 will not be necessary.

As shown in FIG. 6, the control nose 6 may be constructed to be relatively slim in comparison to an area of the actuator 5 resting on the running rail 3, whereby an elasticity of the control nose 6 can be achieved. For example, the control nose 6 is elastically movable perpendicularly with respect to a connection plane between the running rail 3 and the actuator 5. This creates an advantage that, in the case of a faulty operation, which in the end cannot be excluded and during which the above-described interaction between the self-retracting device 4 and the actuator 5 was canceled, the intended condition can automatically be established in that the running rail 3 is moved once back into this completely closed position. In this case, the control nose 6 can yield laterally. In the completely closed position the control nose 6 will spring back into its normal position and, in the process, will again engage in the driving device 7 of the self-retracting device 4.

The fact that the actuator 5 may be completely made of a plastic material also results in a high reduction of noise when the actuator 5, with its control nose 6, is again caused to contact the driving device 7 of the self-retracting device 4.

Figure 7:
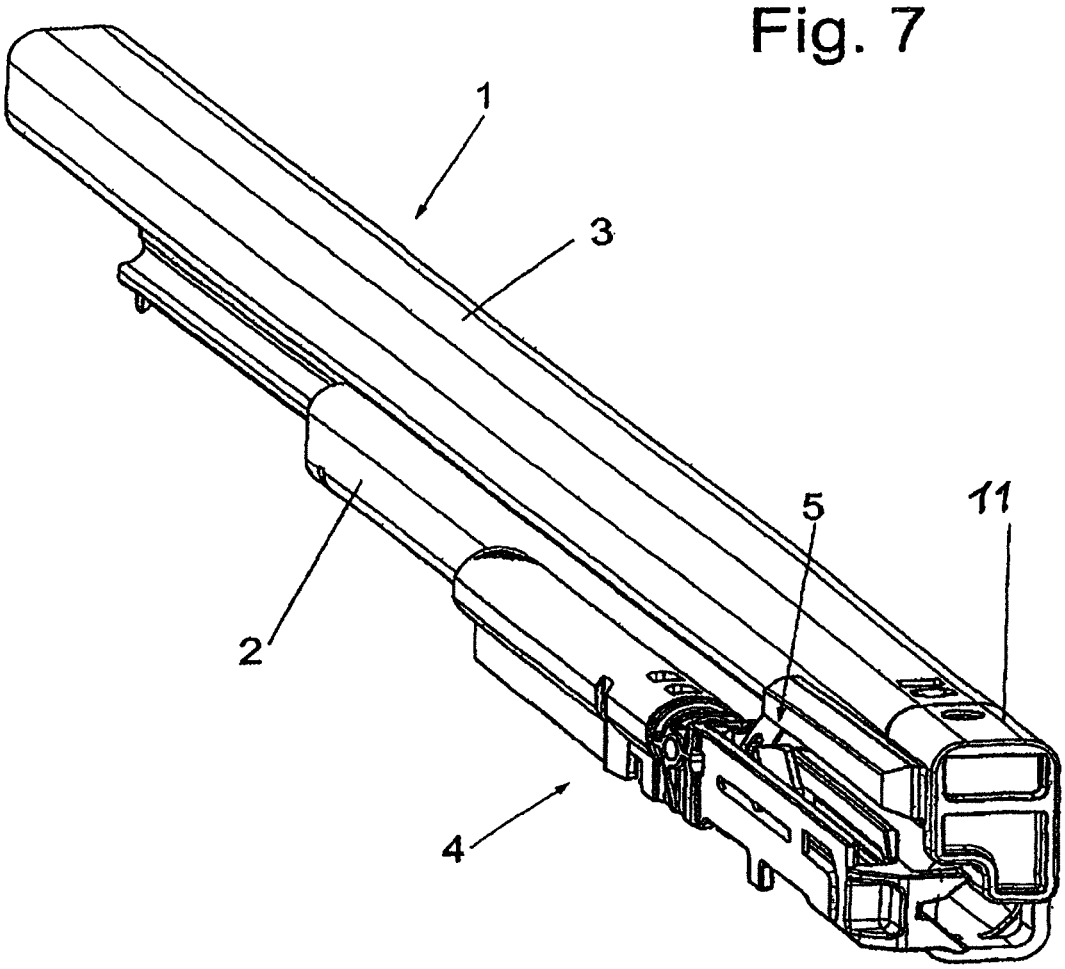
FIG. 7 is a perspective view similar to FIG. 1, of a pull-out guide with a self-retracting device, according to a further embodiment of the present disclosure.
Figure 8:
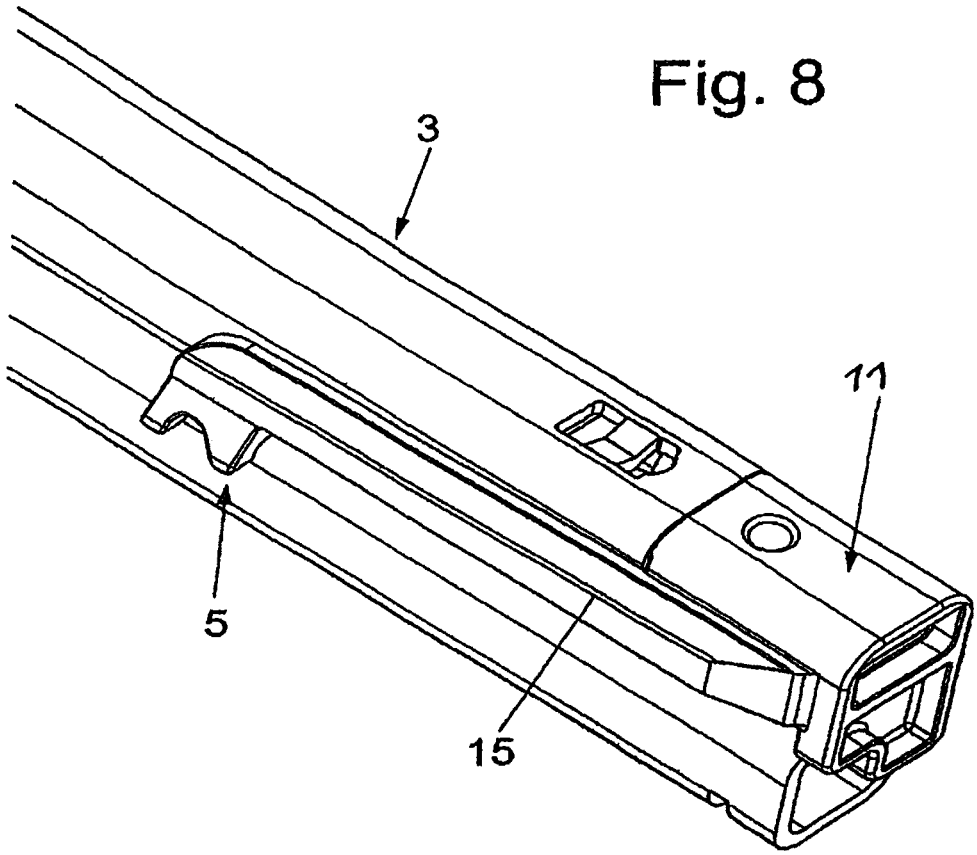
FIG. 8 is a perspective view of the forward end area of the running rail of FIG. 7 equipped with an actuator.

FIG. 7 illustrates a pull-out guide 1 with a self-retracting device 4, wherein the actuator 5 for controlling the self-retracting device 4 forms a subassembly with a closing stopper 11, which, as a whole subassembly, is attached to the running rail 3 of the pull-out guide 1.

Figure 9:
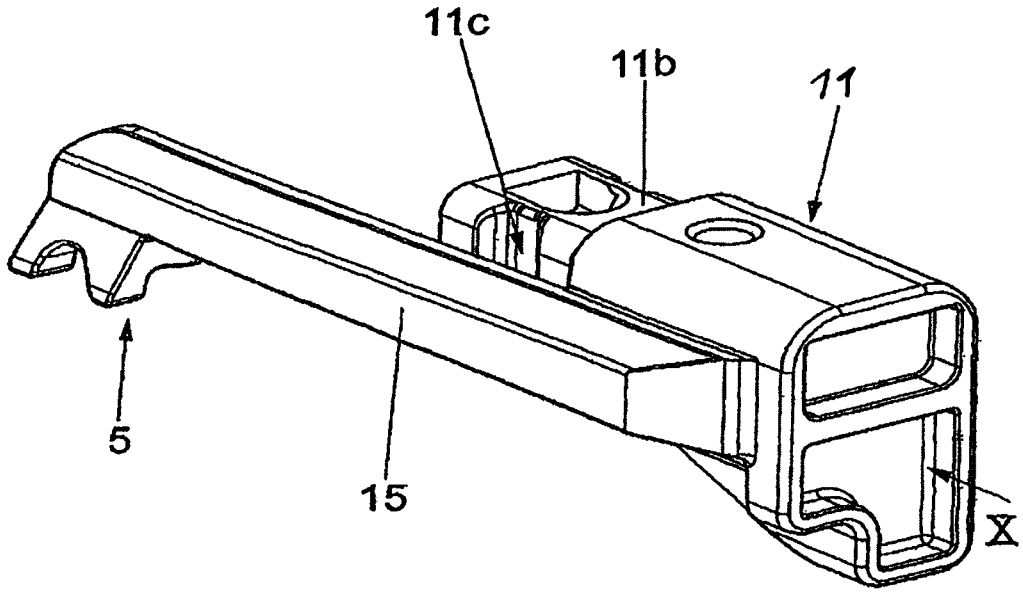
FIG. 9 of a perspective view of a subassembly, comprising the actuator and a closing stopper for the running rail, according to an embodiment of the present disclosure.

In this case, the subassembly formed of the actuator 5 and the closing stopper 11 may be constructed as a one-piece component, as shown, for example, in FIG. 9. The fixing of the entire subassembly with respect to the running rail 3 takes place in an interlocking and/or frictional manner. Thus, for example, an area 11*b* of the closing stopper 11 engaging in the running rail 3 may be equipped with detent grooves 11*c* extending transversely with respect to the longitudinal axis of the running rail 3. Into the detent grooves 11*c* detent devices can be snapped which are provided on the running rail 3 and are stamped through to the inside, in order to fix the subassembly with respect to the running rail 3. It is within the scope of the present disclosure that other types of connections may also be implemented. For example, the running rail 3 may be provided with openings in which detent projections or detent hooks engage which are molded onto the area 11*b* of the closing stopper 11 projecting into the running rail 3.

Within the scope of the present disclosure, all detent connections suitable for causing a fixing of the subassembly are possible, which may include the actuator 5 and the closing stopper 11*a* with respect to the running rail 3, which fixing is secure in the axial direction of the running rail 3.

However, the closing stopper 11*a* can also be fixed to the running rail 3 by a stamping of the running rail 3.

This may have the advantage that a simple and uncomplicated fixing of the actuator 5 on the running rail 3 is ensured. In addition, this embodiment according to the present disclosure may also permit the subsequent mounting of an actuator 5 on a running rail 3 of a pull-out guide 1.

As previously mentioned, the subassembly including the actuator 5 and the closing stopper 11 may be constructed as a one-piece component, such as an injection-molded part.

In accordance with the present disclosure, it is also conceivable to mutually connect a separately manufactured actuator 5 and a separately manufactured closing stopper 11 by way of known connecting devices in a secure manner such that these form a completely prefabricated subassembly.

Figure 10:
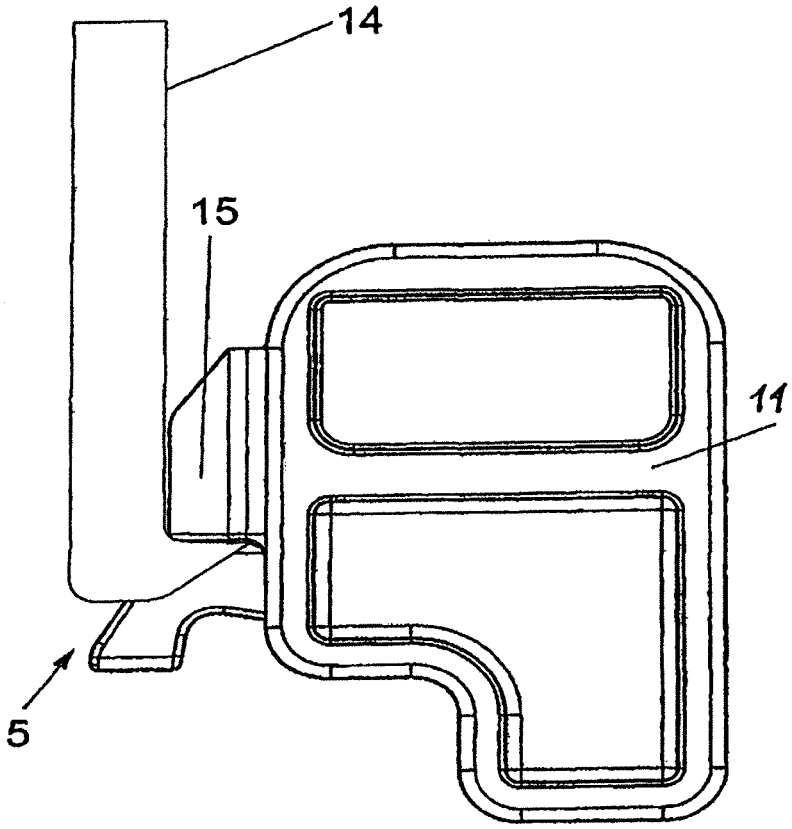
FIG. 10 is a view in the direction of the arrow X in FIG. 9 showing a detent hook of a drawer.

FIG. 10 shows a detent hook 14 which is shown only in a very abstracted manner and is fixedly connected with a drawer (not shown) and resting on the top side of the running rail 3 or is manufactured in one piece with the drawer. As shown in FIG. 10, this detent hook 14 can reach under a longitudinal web 15 of the actuator 5/closing stopper 11 subassembly after the drawer is placed on a running rail 3, so that the drawer is secured with respect to a lifting-off.

Figure 11:
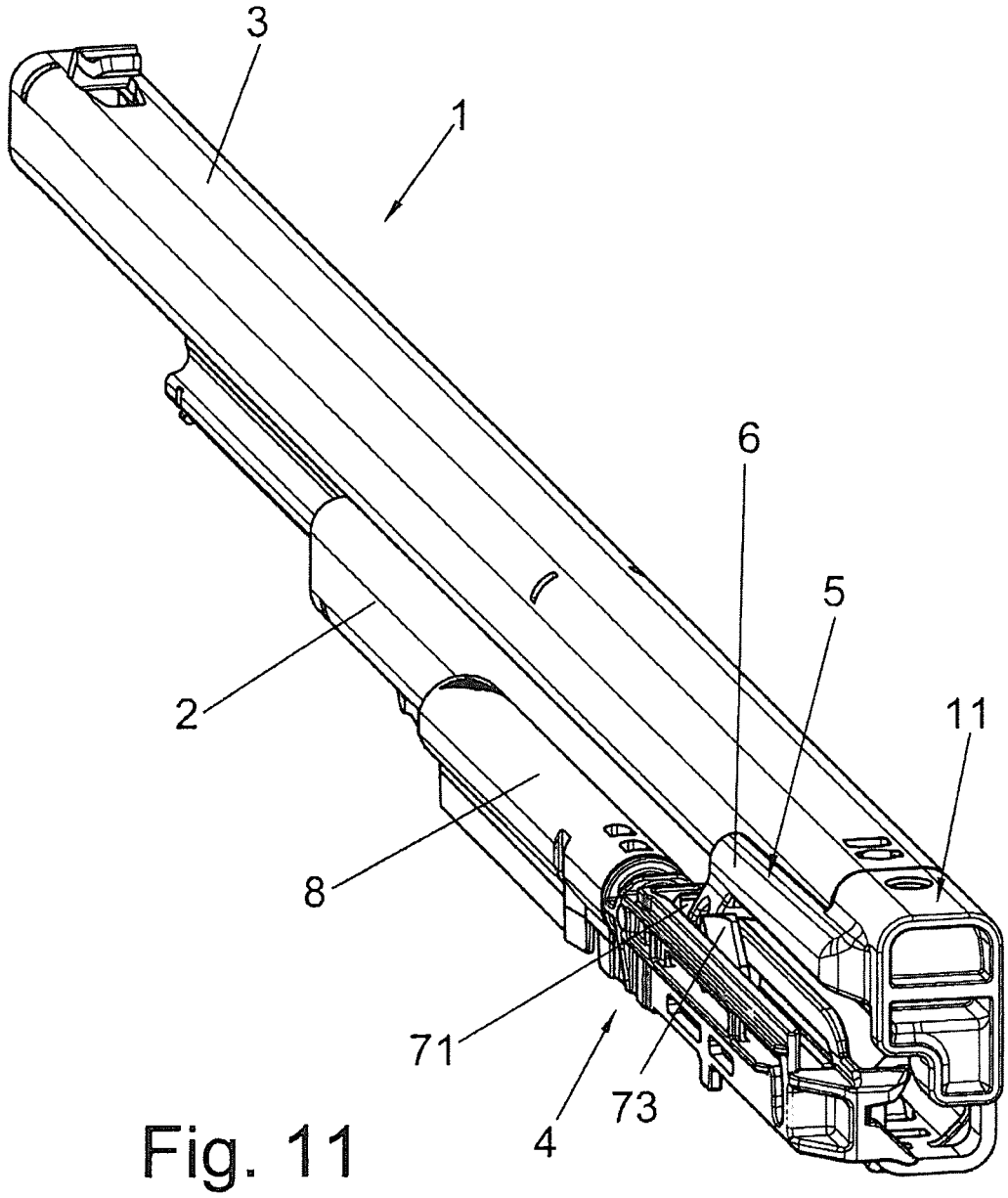
FIG. 11 is a perspective view of the pull-out guide of FIG. 1, according to the present disclosure, showing a self-retracting device in the pushed-together closed condition.

FIGS. 11 to 21 illustrate a pull-out guide 1 with a self-retracting device 4, wherein the actuator 5 for controlling the self-retracting device 4 forms an integrally formed subassembly with a closing stopper 11, which, as a whole subassembly, is attached to the running rail 3 of the pull-out guide 1. FIGS. 11 to 14 illustrate a normal working procedure of the pull-out guide 1, where, when the running rail 3 is in its closed position, the control nose 6 is in engagement with the driving device 7 of the self-retracting device 4, as shown in FIG. 11.

Figure 12:
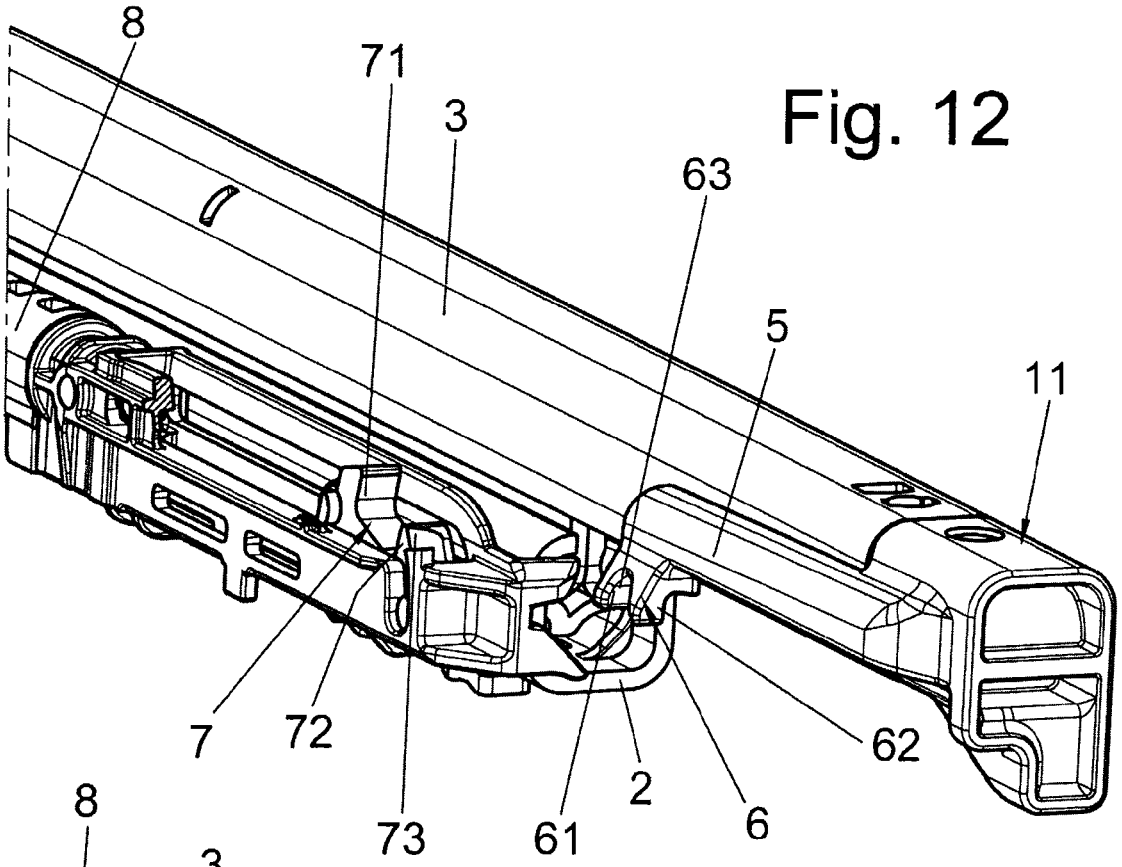
FIG. 12 is a perspective view of the pull-out guide of FIG. 11 after the separation of the actuator from the self-retracting device.

In FIG. 12 the running rail 3 is pulled out and the driving device 7 is pushed by the control nose 6 of the activator 5 in its tilted position, where the control nose 6 is not in engagement with the driving device 7, such that the running rail 3 mounted on the drawer or the like can be fully opened.

Figure 13:
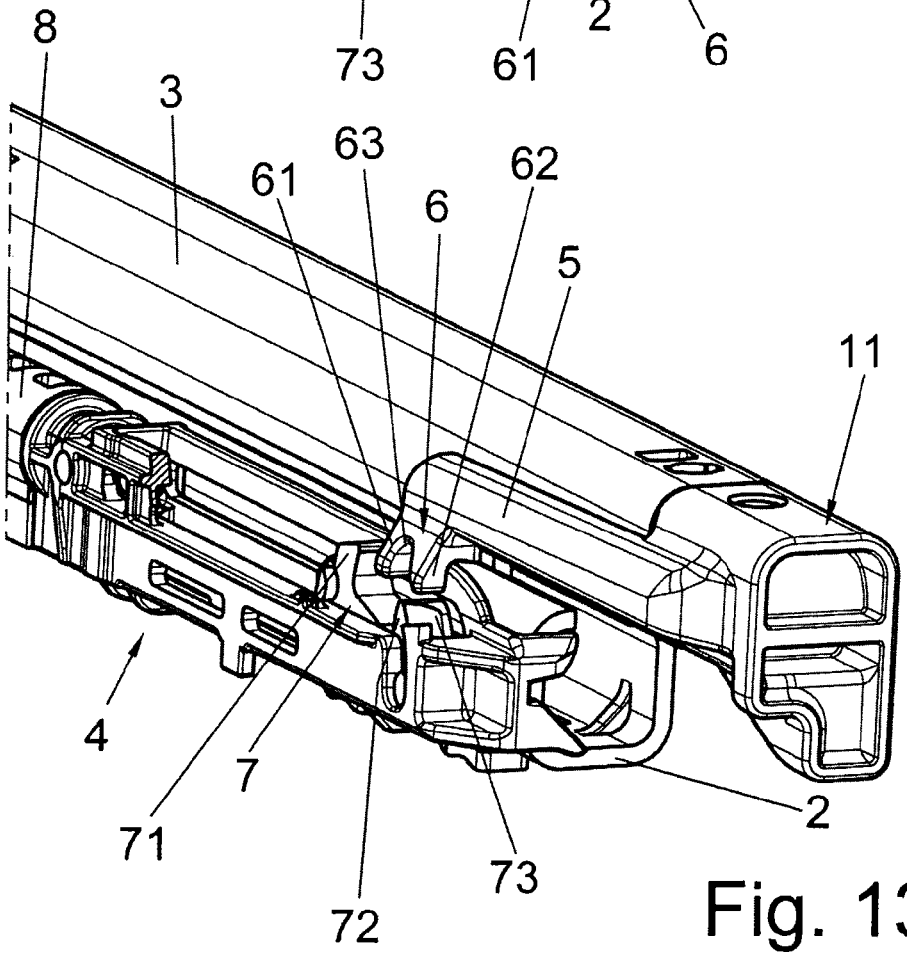
FIG. 13 is a perspective view of the pull-out guide of FIG. 11 before the control nose of the actuator is back in contact with the self-retracting device.
Figure 14:
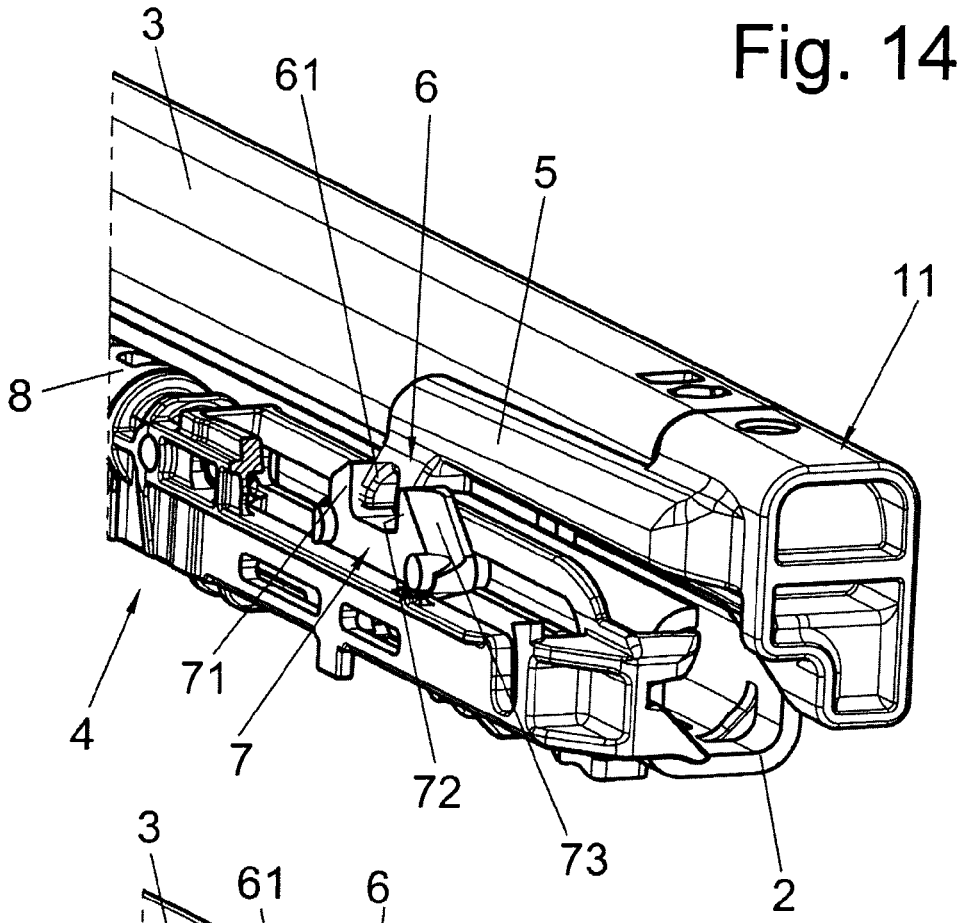
FIG. 14 is a perspective view of the pull-out guide of FIG. 11 with the control nose of the actuator being back in contact with the self-retracting device.

In FIG. 13 the running rail 3 has been pushed back in a direction of its starting position, in order to close the drawer, where a first, or left, tooth 61 of the control nose 6 contacts a first, or left, wall 71 of the driving device 7 in order to tilt the driving device 7 back in its horizontal position and encompass the control nose 6, such that, as shown in FIG. 14, where the running rail 3 is pushed back further in the direction of its starting position and the control nose 6 is back in engagement with the driving device 7. A second, or right, wall 72 of the driving device 7 is in the position shown in FIG. 13, still in a lowered position, such that the control nose 6 passes wall 72 without contacting it. As can be seen from FIGS. 13 and 14, the control nose 6 has tooth 61 and a second, or right, tooth 62 with an arc-like bridge, or space, 63 therebetween.

Figure 15:
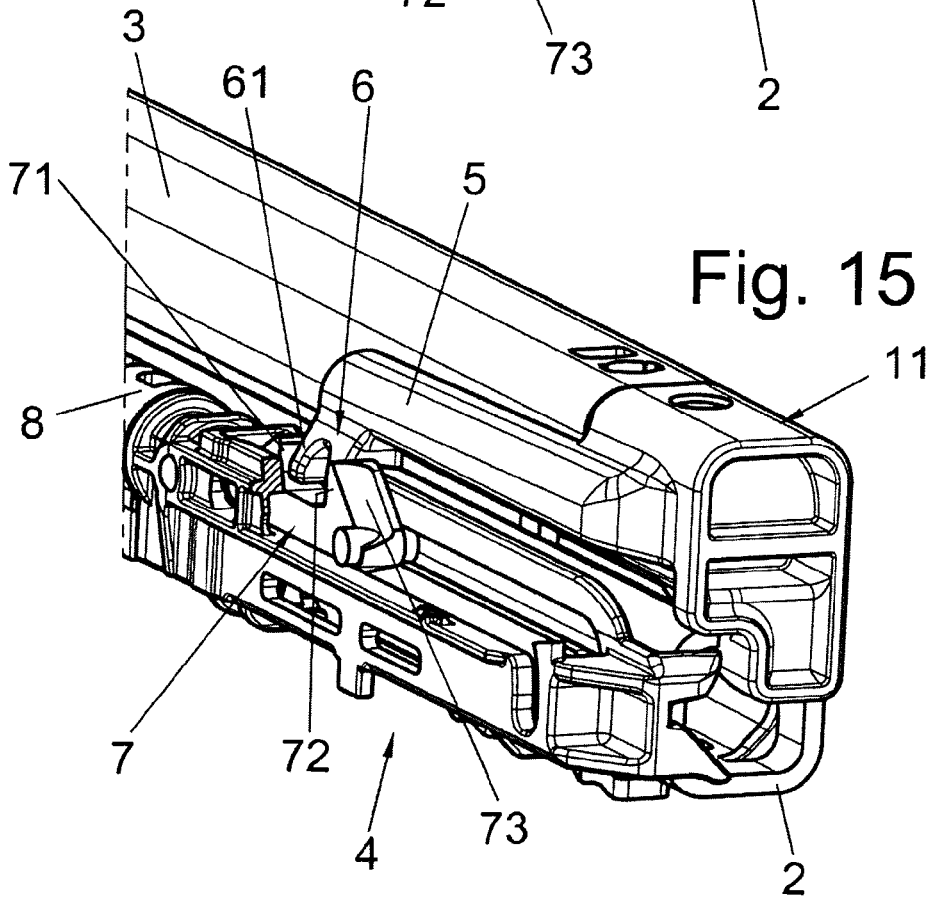
FIG. 15 is a perspective view of the pull-out guide of FIG. 11 with the actuator being back in the position shown in FIG. 11.

FIGS. 15 to 21 show a condition representing the faulty operation of the pull-out guide 1 previously referred to, starting again with the running rail 3 in its starting position as shown in FIG. 15.

Figure 16:
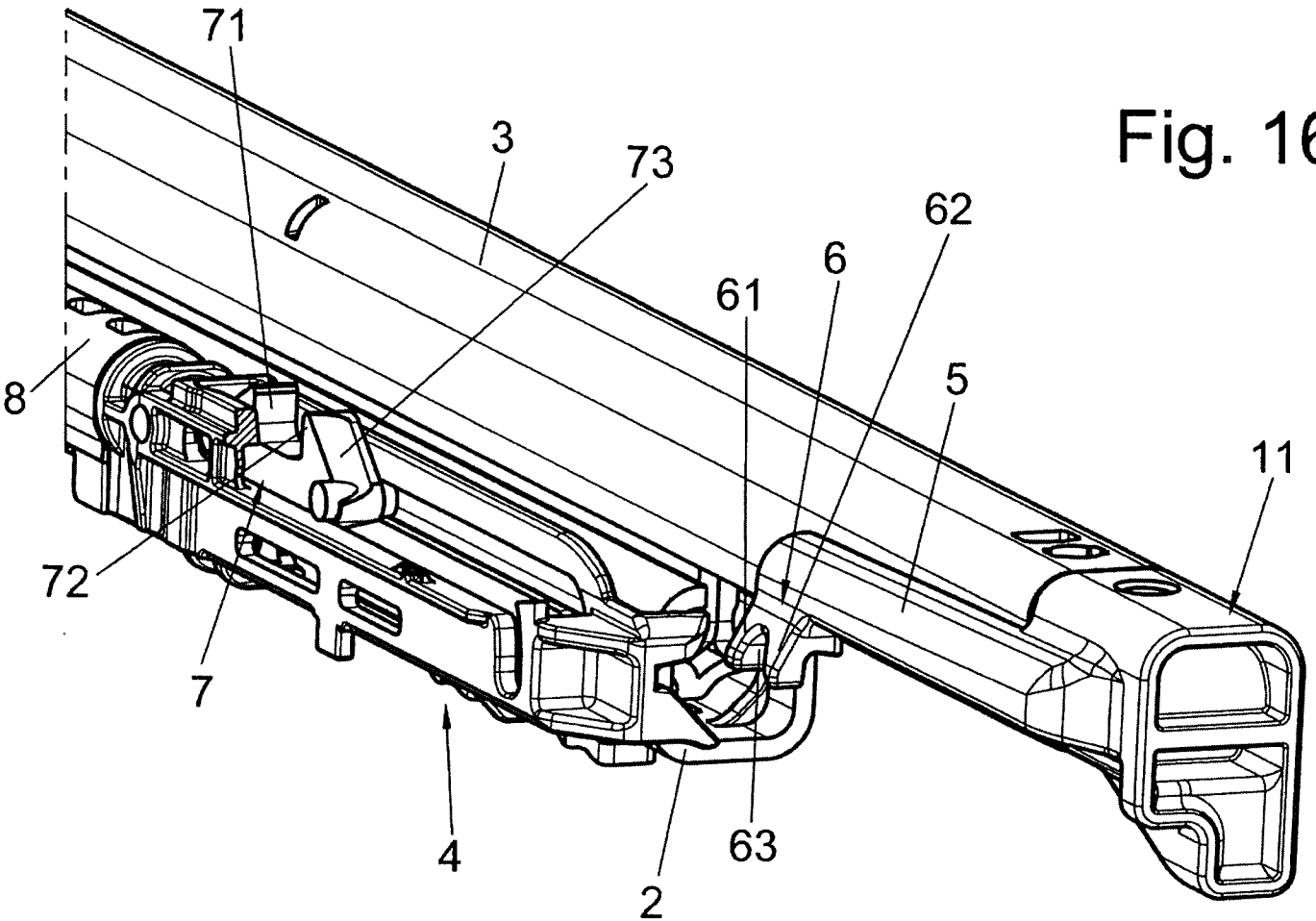
FIG. 16 is a perspective view of the pull-out guide of FIG. 11 after the separation of the actuator from the self-retracting device after a faulty operation, where the self-retracting device has not been pulled out together with the running rail.
Figure 17B:
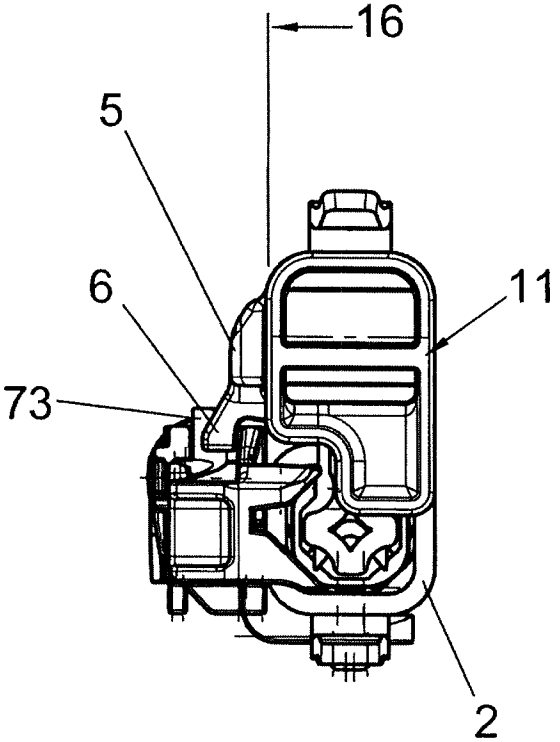
FIG. 17*a* is a perspective view and FIG. 17*b* is a front view of the pull-out guide of FIG. 11 before the control nose of the actuator is back in contact with the self-retracting device.
Figure 17A:
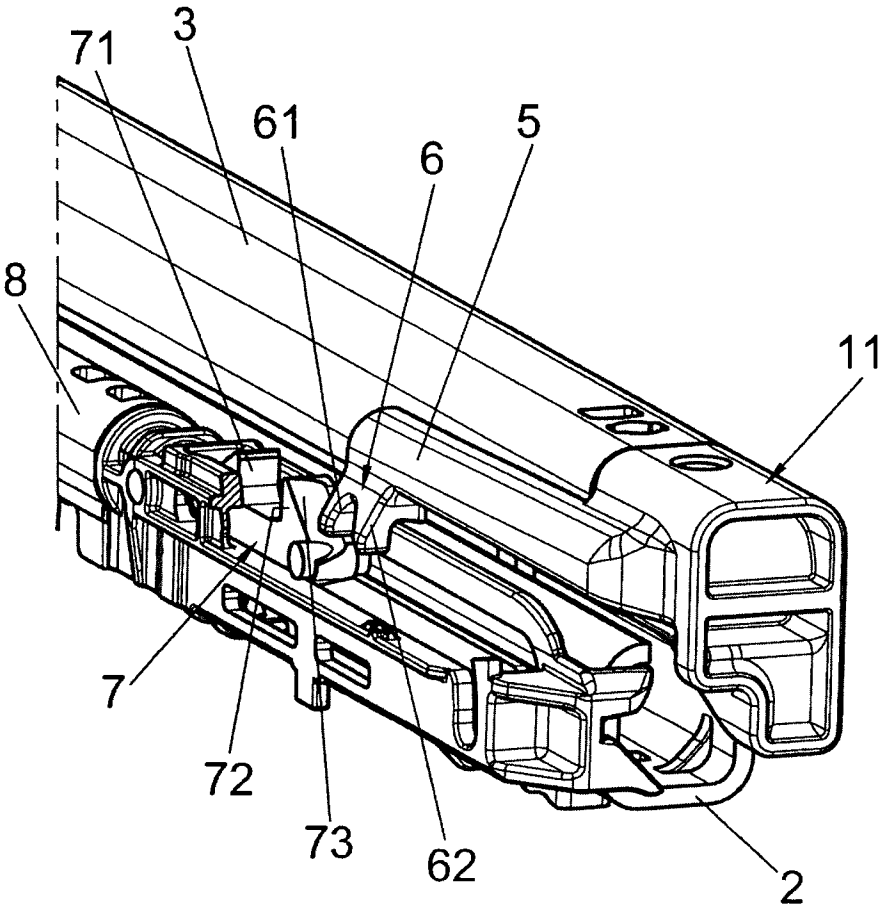

FIG. 16 shows the pulled out running rail 3 with the driving device in an unintended or faulty position. A desired condition of the driving device 7 would have it in its tilted position, as shown in FIG. 13. As can be seen in FIG. 16, the driving device 7 has not been moved due to the faulty operation and thus not been pushed by the control nose 6 into its tilted position.

In order to re-establish the pull out guide 1 in its intended condition, the running rail 3 and with it the actuator 5 has to be pushed backwards into its starting position. On its way back, tooth 61 (see FIG. 17*a*) of control nose 6 moves along a curved plane 73 of wall 72 of the driving device 7 forcing the actuator 5 to yield laterally, relative to the moving direction of the running rail 3, starting from a connection plane 16 shown between the running rail 3 and the actuator 5. This can be seen by comparing the front views of the pull-out guide 1 in FIG. 17*b* and FIG. 18*b*. As shown in FIG. 18*c*, the free end of the actuator 5 is forced away from the running rail 3 in direction A by the curved plane 73 of wall 72 creating a space 17 between the free end of the actuator 5 and the running rail 3.

As can be seen in FIGS. 14 and 15, wall 72 is formed such that it has a width equal, or substantially equal, to a width of wall 71 of the driving device 7 on its side facing wall 71. The width of the second wall 72 has a slope in a moving, or the pull out, direction of the running rail 3 on the hyperbolically formed curved plane 73. Thus, when the control nose 6 moves along curved plane 73, the actuator 5 is pushed laterally with respect to the moving direction of the running rail 3, as shown in FIGS. 18*a*, 18*b*, and 18*c*.

Figure 19:
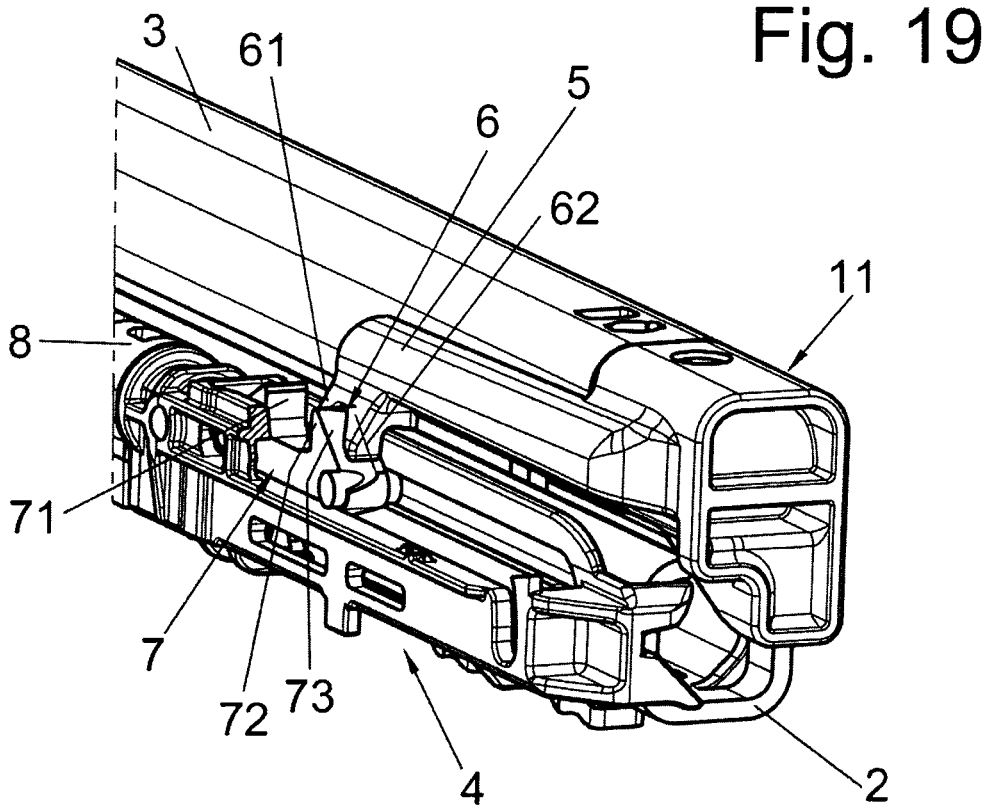
FIG. 19 of a perspective view of the pull-out guide of FIG. 11 where a tooth of the control nose has passed a wall of driving device of the self-retracting device.

After tooth 61 of control nose 6 has passed curved plane 73 of wall 72 of the driving device 7, as shown in FIG. 19, actuator 5 has sprung back in a position parallel to the running rail 3, while wall 72 with curved plane 73 is positioned in the bridge or space 63 between tooth 61 and tooth 62 of control nose 6. In this position the actuator is able to move the driving device 7 with it.

Figure 20:
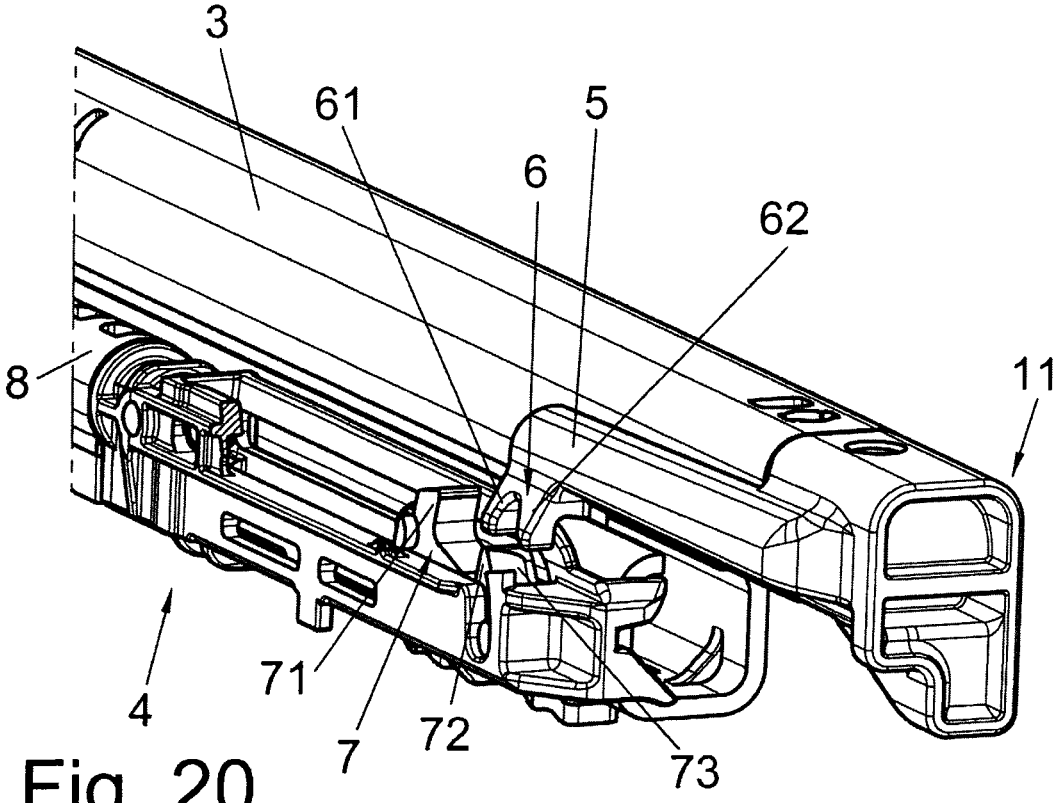
FIG. 20 is a perspective view of the pull-out guide of FIG. 11 immediately after the separation of the actuator from the driving device of the self-retracting device with the self-retracting device in a normal position.

After the previously-described faulty operation, the running rail 3 again has to be pulled out in an opening direction, where the driving device 7 is pushed by the control nose 6 into its tilted position and thus the faulty operation has been corrected, as shown in FIG. 20.

Figure 21:
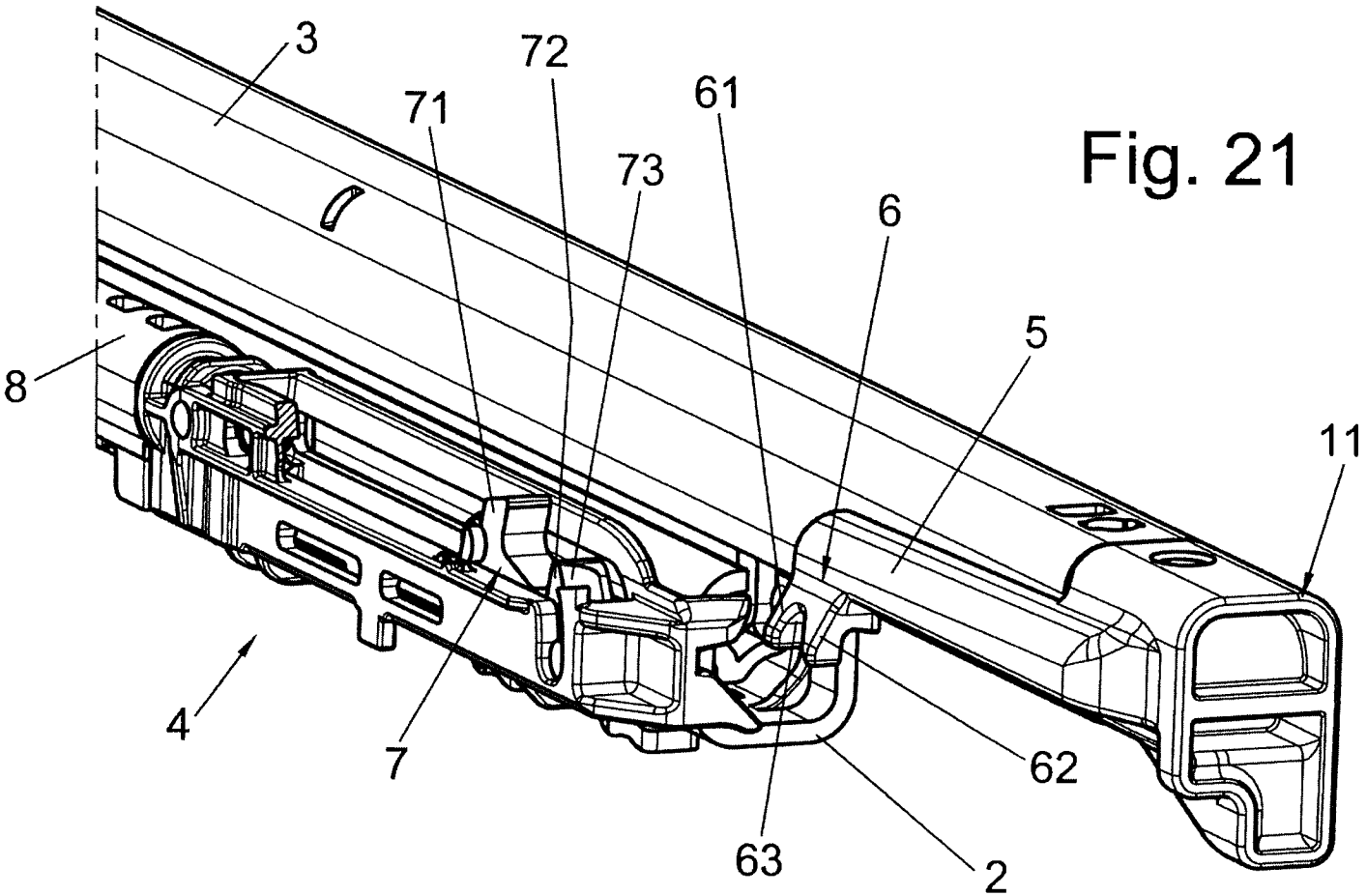
FIG. 21 is a perspective view of the pull-out guide of FIG. 11 after the separation of the actuator from the driving device of the self-retracting device with the self-retracting device in a normal position, as also shown in FIG. 12.

FIG. 21 shows the position of the pull-out guide 1 with the pulled out running rail 3 in normal operation as also shown in FIG. 12.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A pull-out guide for a drawer or pull-out of furniture, the pull-out guide comprising:

a guide rail attachable to a body of the furniture;

a self-retracting device mounted on the guide rail, the self-retracting device including a driving device;

a running rail mountable on the drawer;

an actuator attached to the running rail to control the self-retracting device;

wherein the actuator and a closing stopper are inserted in a forward area of the running rail and the actuator and the closing stopper form a sub-assembly, which sub-assembly is attached by one or both of an interlocking and a frictional fixing on the running rail; and further wherein the actuator includes a control nose which selectively engages with the driving device and the control nose of the actuator is configured to be moved by the driving device perpendicularly with respect to a connection plane between the running rail and the actuator in an elastic manner to enable transition of the control nose from a disengaged position with respect to the driving device and an engaged position with respect to the driving device.

2. The pull-out guide according to claim 1, wherein the subassembly formed of the actuator and the closing stopper is constructed as a one-piece component.

3. The pull-out guide according to claim 2 wherein the one-piece component is made of a plastic material.

4. The pull-out guide according to claim 2, wherein the subassembly is constructed as a one-piece injection-molded part.

5. The pull-out guide according to claim 1, wherein the driving device is a U-shaped driving device having a first wall and a second wall that includes a curved plane.

6. The pull-out guide according to claim 1, wherein the actuator has a first tooth, a second tooth, and bridge therebetween.

7. The pull-out guide according to claim 1, wherein the closing stopper is inserted into the running rail and the closing stopper includes detent grooves into which corresponding detent devices of the running rail engage.

8. The pull-out guide according to claim 1, wherein the running rail includes actuator openings, and detent elements molded onto the actuator that dip into the running rail engage in the actuator openings.

9. The pull-out guide according to claim 1, wherein the closing stopper is used to fix the subassembly to the running rail.

* * * * *